United States Patent [19]

Barker

[11] 4,265,487

[45] May 5, 1981

[54] HIGH PRESSURE WATER JET MINING MACHINE

[75] Inventor: Clark R. Barker, Rolla, Mo.

[73] Assignee: The Curators of the University of Missouri, Columbia, Mo.

[21] Appl. No.: 82,537

[22] Filed: Oct. 9, 1979

Related U.S. Application Data

[63] Continuation-in-part of Ser. No. 894,769, Apr. 10, 1978, abandoned.

[51] Int. Cl.[3] ..... E21C 25/60

[52] U.S. Cl. ..... 299/34; 299/17

[58] Field of Search ..... 299/17, 81, 34, 12

[56] References Cited

U.S. PATENT DOCUMENTS

| | | | |
|---|---|---|---|
| 3,887,235 | 6/1975 | Koppers | 299/17 |
| 4,181,363 | 1/1980 | Goris | 299/17 |

OTHER PUBLICATIONS

"Experimentation in Hydraulic Coal Mining", Preprint 77-F-32, SME-AIME, 1977 AIME Meeting, Mar. 6-10, 1977.

Information on Experience with Longwall-Face Set to Hydraulic Cutting at Ryner Colliery, Central Mining Institute, Oct. 1966.

*Primary Examiner*—William F. Pate, III

*Attorney, Agent, or Firm*—Ray E. Snyder

[57] ABSTRACT

A high pressure water jet mining machine for the longwall mining of coal is described. The machine is generally in the shape of a plowshare and is advanced in the direction in which the coal is cut. The machine has mounted thereon a plurality of nozzle modules each containing a high pressure water jet nozzle disposed to oscillate in a particular plane. The nozzle modules are oriented to cut in vertical and horizontal planes on the leading edge of the machine and the coal so cut is cleaved off by the wedge-shaped body.

6 Claims, 3 Drawing Figures

11
16
34
39
36
30
10
39
31
12
37
38
17
35
33
32
40
13
14
19
18
20
15
T 50
40
5cm
20
33
32
51
60cm 212
230
237
233
232
WATER JET
231
238

HIGH PRESSURE WATER JET MINING MACHINE

The Government as rights in this invention pursuant to Contract ET-75-C-01-9097 awarded by the U.S. Department of Energy.

BACKGROUND OF THE INVENTION

This is a continuation-in-part of application Ser. No. 894,769 filed Apr. 10, 1978 now abandoned.

1. Field of the Invention

This invention relates generally to the field of boring or penetrating the earth, and more particularly to the longwall mining of coal using high pressure water jets for cutting of coal.

2. Description of the Prior Art

The use of high pressure water jets in mining is well known in the art, particularly in the mining of coal. Water jet mining has been practiced commercially in Europe for a number of years. (Central Mining Institute—Symposium on Hydraulic Transport of Coal Underground and at the Surface "Information on Experience with the Longwall Face Set for Hydraulic Cutting of Coal at Rymer colliery" by M. Duczmal et al, published October, 1966.) The feasibility and advantages of high pressure water jet mining are also set forth in a paper entitled "Water-Jet Mining of Coal—A Promising Technique on the Way" published in Coal Age, March, 1972 by Nicholas P. Chironis, pages 67–71. Information describing "Experimentation in Hydraulic Coal Mining" utilizing an earlier prototype of the machine of the present invention appeared in Preprint No. 77-F-32 in the "Society of Mining Engineers of AIME" and was described in a paper presented at the 1977 AIME Annual Meeting in Atlanta, Ga., on Mar. 6–10, 1977.

Water jets have also been used in conjunction with other cutting machines for the removal of coal and other materials. Machines for this general purpose are exemplified by the following patents:

| | | |
|---|---|---|
| Kirschniok | 878,208 | MINING PROCESS |
| Haas | 2,064,660 | APPARATUS FOR EXTRACTING MATERIALS |
| Joy | 2,131,180 | METHOD OF MINING COAL |
| Huff | 2,678,203 | HYDRAULIC JET CUTTING AND PUMPING APPARATUS FOR MINING HYDROCARBON ACEOUS SOLIDS |
| Dowie | 2,867,426 | USE OF HIGH PRESSURE FLUIDS IN COAL MINES |
| Andersen | 3,203,736 | HYDRAULIC METHOD OF MINING COAL AND THE LIKE |
| Lobbe | 3,306,665 | WATER GUN REMOTELY MOUNTED ON PLANER CUTTER GUIDE |
| Chaney | 3,554,602 | EXCAVATING METHOD AND APPARATUS |
| Messer et al. | 3,744,847 | APPARATUS FOR RECOVERING UNDERGROUND DEPOSITS OF SOLUBLE MINERALS |
| Koppers | 3,887,235 | ASSEMBLY FOR HYDRAULIC EXTRACTION OF SHEET-LIKE MINERAL DEPOSITS SECTIONED INTO PANELS BY A SYSTEM OF PASSAGES |

The machines illustrated and described in the above patents have met with very limited commercial success. Such machines generally require an inordinately large volume of water and have not been very efficient in terms of cutting speed and in the amount of material extracted. The jets they used have a limited depth of penetration and therefore a limited usefulness for the cutting of coal.

The Koppers patent, U.S. Pat. No. 3,887,235, cited above, is probably the most germane to the present invention, and it kindly acknowledges the pioneer work conducted at The University of Missouri by Summers et al. (Col. 1, lines 59–68, and Col. 2, lines 1–3). Koppers in FIG. 2, employs a plurality of oscillating nozzles oriented to cut perpendicularly into the face of the coal. His nozzles oscillate on a short arc and are completely exposed, permitting contact with and potential damage by the material being cut. Moreover, this method of cutting at the top and bottom does nothing to attack and release the central section of the coal, which has been found to be necessary. The embodiment shown in FIG. 2 does not represent what is known as conventional longwall mining. The embodiments of FIGS. 4 and 5 more closely resemble machines for longwall mining. However, these embodiments employ a large number of fixed nozzles with a correspondingly large power requirement for supplying the nozzles. Koppers relies totally on water jet action for material fracturing from the face, and does not disclose or employ any mechanical means for fracturing or material removal.

The earlier prototype of the present invention described in the AIME article was found to have several critical deficiencies which made it unacceptable for the commercial mining of coal. In particular, the original head design had a rectangular opening on the front of each cutting edge through which the water jets were ejected. It was found that relatively large pieces of coal could float through the rectangular opening in a slurry of water could jam the oscillating cutting arms. In addition, the mechanism for driving the oscillating arms was not isolated from the compartment containing the oscillating arms.

It was also found that for the machine to advance unimpeded, the slot cut must be unobstructed and wide enough to allow the leading edge of the plow to enter the slot. This was found difficult to attain where pyrites or other hard material, which did not cut as readily as coal, was present in the seam in the path of the moving plow. It was found that the presence of such materials could contact the leading edge of the plow and completely stop advance of the machine.

The machine of the present invention as a whole utilizes high pressure water jets in vertical and horizontal planes to profile the web of coal mined by the machine as it is advanced along a longwall face. As the web is profiled, the wedge-shaped modules continuously advance into the slots so cut, cleaving the coal from the face and moving it onto an adjacent conveyor. This principle has in part been previously used in a successful mining machine known as a "Meco Moore", which instead of using high pressure water jets to affect the cutting, used a series of saws to make slots at the bottom, the back, and halfway up the face.

SUMMARY OF THE INVENTION

The high pressure water jet mining machine of the present invention has demonstrated the feasibility of mining coal using a combination of high pressure water jets as cutting tools and mechanical wedging in unitary machine, and is capable of doing so on a continuous and commercially viable basis. This machine has a significant number of advantages over nearly all mechanical mining machines currently in use. These advantages are:

1. Coal is mined without generating respirable dust;
2. The noise level generated by the machine is well within mine safety standards;
3. The machine has no moving parts which come in contact with the coal at sufficient velocity to generate sparks, thus eliminating face ignition problems;
4. The force required to move the machine is significantly less than that required for conventional shearers under equivalent conditions. In addition, shock loads are virtually eliminated because of the manner in which the coal is mined;
5. The type of slot which can be cut by the jets can be controlled by nozzle geometry. In addition, nozzle geometry can be adjusted to produce desired size for the pieces of coal removed and can also control the degree to which the coal is infused with water;
6. Extremely hard material which might be present in the coal, such as pyrite and shale, can be cut using pressures of 700 bar or less;
7. Unlike a conventional shearer, which is limited in advance rate by the width of the web being cut, the present machine is not so limited; and
8. Because of the reduced weight and haulage force, the machine can operate efficiently on steep inclines.

It is an object of the present invention to provide an improved high pressure water jet coal mining machine having a body generally in the shape of a wedge or plowshare and employing a plurality of oscillating high pressure water jets movable in an arcuate plane for the cutting of coal. Each of the jet nozzles and the nozzle arms are contained within a replaceable module or sector-shaped housing which is sealed off from a main compartment containing the drive mechanisms for all the nozzle arms. The leading edge of each module has a pair of parallel scimitar-shaped blades of hardened steel which may be replaceable along with the nozzle for particular materials being cut. The space between the parallel blades defines an arcuate exit aperture for the water jets. At least one module is oriented in a horizontal plane on the lower edge of the machine for the bottom cutting of coal. One or more modules are also mounted on the side of the machine and oriented to cut in a vertical plane for the side or face cutting of coal. One or more modules may also be disposed in a horizontal plane on the top of the machine for the top cutting of coal. The leading edges of the respective modules may be staggered or offset longitudinally with respect to the direction of travel for thereby controlling the size of the pieces of coal cut away.

The hardened arcuate blades on the leading edge of each module are effective to break or wedge through pyrites or other hard materials that may be present in the coal seam and which are insufficiently cut by the water jets.

DETAILED DESCRIPTION OF THE PREFERRED EMBODIMENT

Figure 1:
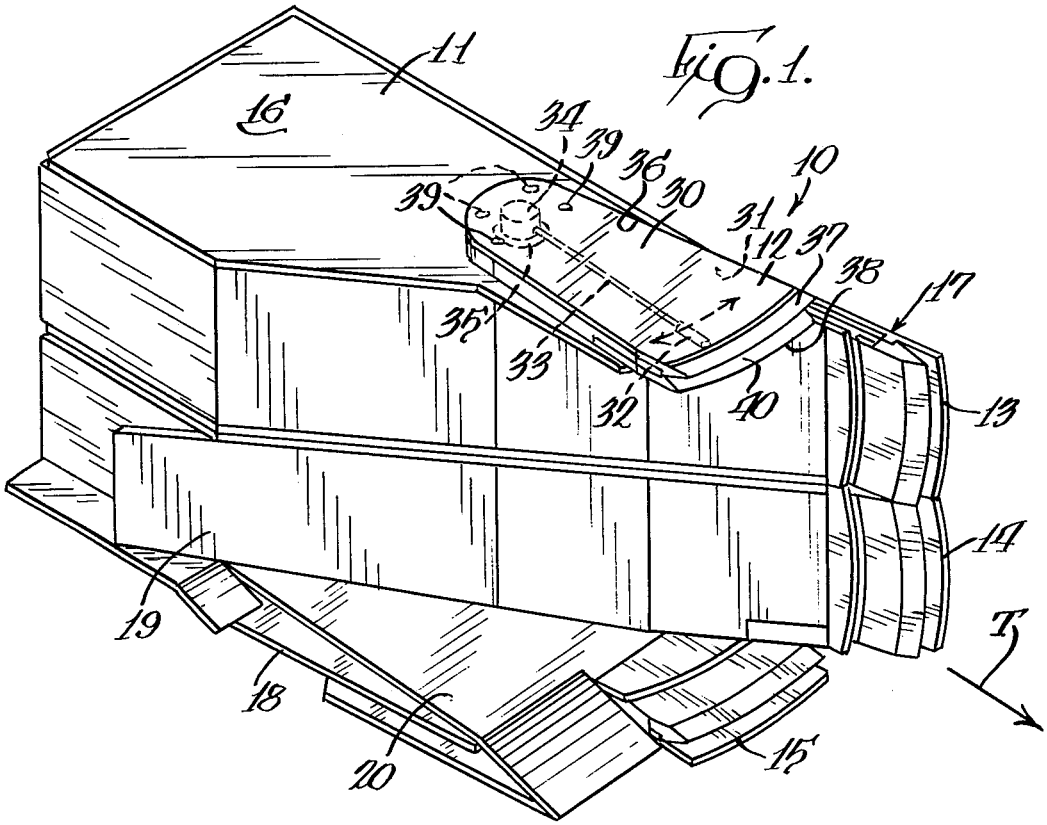
FIG. 1 is a perspective view of the HYDROMINER or water jet mining machine of the present invention.

The improved high pressure water jet mining machine or HYDROMINER of the present invention is illustrated in FIG. 1 and is designated generally by the numeral 10. The machine 10 comprises a generally wedge-shaped or plowshare-shaped housing 11 and a plurality of nozzle modules 12, 13, 14 and 15. The module 12 is mounted in a horizontal plane on the top surface 16 of housing 11. The modules 13 and 14 are mounted one on top of the other in a vertical plane on the side 17 of the housing 11. The module 15 is mounted in the horizontal plane on the bottom of surface 18 of the housing 11. A wedge-shaped cleaving surface 19 is disposed in a vertical plane between the modules 12 and 15. A bottom ramp surface 20 is disposed between the surface 19 and bottom 18 adjacent to module 15.

The drive mechanisms (not shown) for all of the modules 12–15 are contained within the interior of the housing 11. The module 12 is shown partially in a phantom view and should be regarded as typical and, in fact, interchangeable with the other modules, except as hereinafter noted. The module 12 comprises a flat housing with an upper surface 30 and a lower surface 31, a nozzle 32 and a nozzle arm 33 are mounted to oscillate in an arcuate plane between the surfaces 30 and 31. The arm 33 is attached to a drive shaft 34 which extends into the interior of the housing 11. The shaft 34 is sealed at 35 so as to isolate the interior space 36 of the module 12 from the interior of the housing 11. An arcuate leading edge or blade 37 is rigidly attached to the upper plane 30 and a parallel blade or leading edge 38 is attached to the bottom plane 31. A narrow slot 40 is defined between the edges 37 and 38. The slot 40 lies in the plane of motion of nozzle 32 and provides and exit aperture for the jet streams ejected by the nozzle 32. The drive mechanism for each of nozzle arms 33 are designed to oscillate them at a speed of approximately 150 cycles/per min. Each of the nozzles 32 have orifices approximately 1 mm. in diameter.

It is contemplated that the nozzles 32, the blades 37 and 38, and the entire module 12–15 may be easily replaceable for cutting different materials or for accommodating for different mining conditions.

Figure 3:
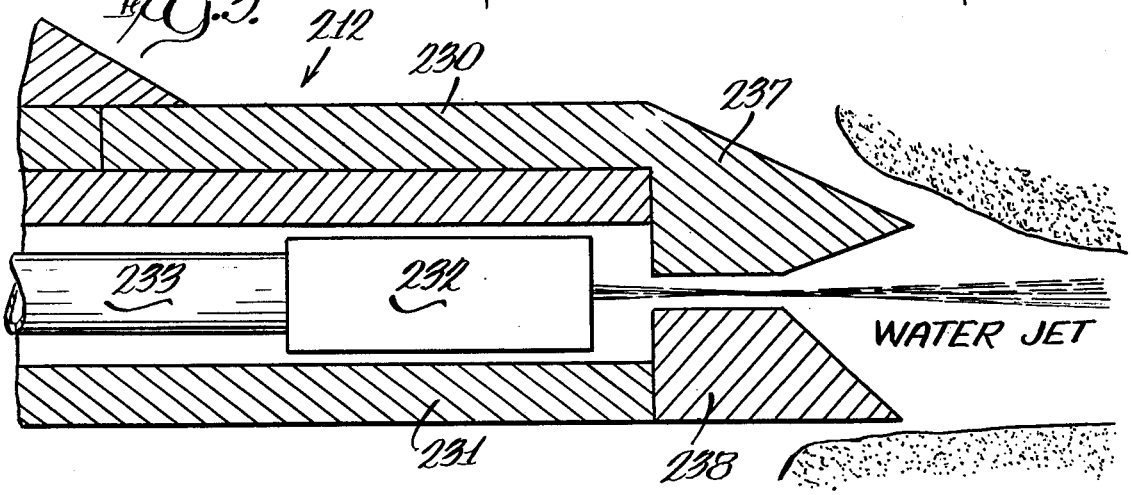
FIG. 3 is an enlarged cross-sectional view of the leading edge of the water jet module for cutting through hard materials.

The leading edges 37 and 38 are preferably formed of hardened steel and are sharpened on their convex edge similar to a scimitar blade. This permits nearly point contact of the edge 37 or 38 with a pyrite lens or other hard material insufficiently cut by the water jets for easily breaking through such material, as shown in FIG. 3. This scimitar shape of blades 37 and 38 also assure that contact with the coal will be made at a plurality of points and at different times as the blades advance into the slots, thereby promoting breakage into pieces of relatively small size. The hard leading edges 37 and 38 and the module housings protect the nozzle 32 and arm 33 of each module from contact with the material being cut. The housing of each module 12–15 is formed with one or more exit apertures 39 near the trailing edge thereof to permit the outflow of water and fine debris that may flow into the module interior 36.

Figure 2:
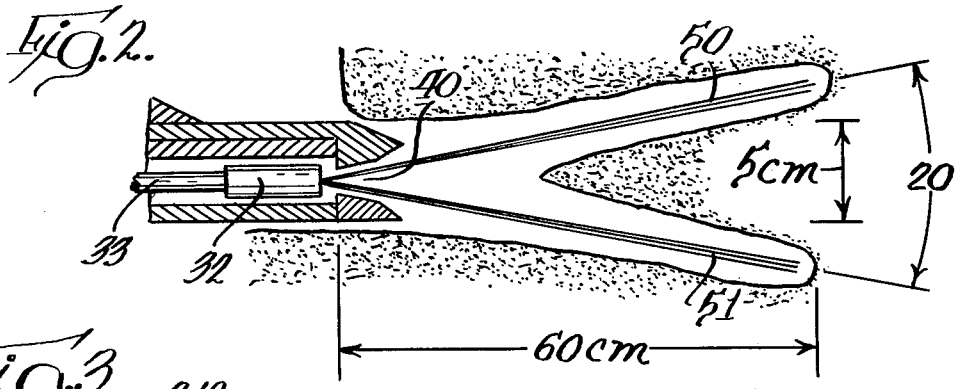
FIG. 2 is a cut-away diagram of a slot cut by a high pressure water jet.

The jet stream ejected by the nozzle 32 preferably is in the form of a pair of diverging jets 50 and 51 as shown in FIG. 2. The jet streams 50 and 51 may be single streams or each may be a pair of converging jet streams for reasons to be described hereinafter. The diverging jets are intended to cut a slot in the coal wide enough to admit the leading edges 37 and 38 of modules 12–15. In the present instance the desired width of slot should be approximately 5 cm. or greater.

In operation the HYDROMINER 10 functions as follows: With a drive pressure of approximately 700 bars. The flow rate through each of the nozzles is approximately 0.038 $m^3$/per min. A suitable haulage mechanism is attached to the HYDROMINER 10 and causes it to move in the direction of arrow T. The drive mechanism contained within the housing 11 causes the nozzle arms 33 within each of the modules 12–15 to oscillate in their respective defined plane. The diverging jets 50 and 51, or converging pairs of diverging jets, cut a slot in the coal as shown in FIG. 2. The depth of cut using the apparatus of the present invention may be as much as 60 cm. and the width so cut is enough to permit the entry of the blades 37 and 38 of each module as the machine 10 advances. The slots cut in the coal fracture it and the loose coal is cleaved off by the action of the wedge face 19 and ramp face 20. The loosened coal plowed off is transferred off the trailing edge of these surfaces to a conveyor (not shown) for removal from the mine. The machine 10 is caused to traverse the full length of the longwall face. The machine 10 is then returned to its original position and moved laterally into position for the next cut.

Predetermined criteria for economical operation of such a machine was that it be capable of an advance rate of 1.5 meters/min. in a coal with a web depth of 60 cm. and a height of 80 cm. In actual operation, the earlier prototype of the machine of the present invention has been run at an advance rate of 3 meters/min. in coal of a web depth of 60 cm. and height of 80 cm. At an advance rate of 1.5 meters/min. in another test the machine 10 has mined coal of a depth of 100 cm. and height of 80 cm. The unit has also been run at an advance rate of 1.5 meter/min. in coal at a web depth of 60 cm. and 138 cm. height. The machine has therefore equalled or surpassed the predetermined criteria for economical operation.

It is contemplated that the machine of the present invention will be a direct replacement for the shearers currently used in longwall mining. In addition to the machine 10 itself, it is contemplated that the machine will ride on an armored face conveyor which is used to carry the coal away. The overlying roof is held in place by a line of roof supports attached to the face conveyor by a set of double acting rams. All of the cutting is done solely by the high pressure water jets and this water itself tends to suppress dust that might be generated in the cutting process. The volume of water so used is relatively small, and in fact is less than that currently used for dust suppression. The noise level is greatly reduced from that of conventional shearers because the water jets and the nozzle modules themselves are generally contained and muffled within the slot of the coal being cut.

The machine of the present invention has no rapidly moving picks or other moving parts which come in direct contact with the coal, thereby virtually eliminating the possibility of face ignition. The cost of pick replacement is also eliminated. The weight of the machine itself is significantly lower than a conventional shearer, and the reaction force of the plurality of nozzles is insignificant compared with the direct contact force of the shearer head against solid coal.

Depending upon the nature and structure of the coal being mined, it is possible to vary the coal cutting conditions by preselection of the nozzle geometry or by controlling the depth of the web being cut. It is also possible to control the size of pieces of coal cut away by varying the longitudinal positions of the modules with respect to the direction of travel. The location of the modules can result in varying the general size of the pieces of coal actually cut away. The fines produced are minimal and the quality of the coal thus mined can be controlled so that the amount and cost of preparation required at a coal processing plant is minimized.

In the mining of coal, there sometimes are encountered foreign materials such as lenses of pyrite and shale which are much harder than the coal. Such materials are very difficult to cut with ordinary water jets. When such materials are commonly encountered, the apparatus of FIG. 1 may be modified as illustrated in FIG. 3.

In FIG. 3 there is illustrated an enlarged modification of a nozzle module 212. The module 212 comprises an upper housing plate 230, a lower housing plate 231, a nozzle and holder 232, and a nozzle arm 233. Case hardened and pointed leading edges 237 and 238 are attached to the plates 230 and 231, respectively. In this embodiment each of the diverging jets 50 and 51, previously described, are replaced by a pair of converging jets. The converging pairs of jets collide to form very fast jets which are much more effective in cutting hard materials.

It is to be understood that the embodiment shown and described is the preferred one and that many changes and modifications may be made thereto without departing from the spirit of the invention. The invention is not to be considered as limited to this embodiment except insofar as the claims may be so limited.

I claim:

1. A machine for mining coal and other geologic materials comprising:

a generally wedge-shaped body portion having a leading edge and adapted to be moved parallel to a working face of material being excavated;

at least one nozzle module mounted on said body portion adjacent said leading edge and containing an arcuately movable nozzle oriented to oscillate in a vertical plane for cutting a vertical slot in the material in advance of the direction of motion of said leading edge;

said module having a housing with a pair of parallel oppositely facing hardened convexly arcuate blades on the leading edge thereof defining an exit slot for water jets ejected from the said nozzle and for protecting said nozzle from contact with the material being cut.

2. The machine of claim 1 including:

drive means contained within said body portion for oscillating said nozzle; and sealing means for isolating the interior or said module from said drive means.

3. The machine of claim 1 including:

at least one module containing an arcuately movable oscillating nozzle mounted on the bottom of said body portion adjacent said leading edge and oriented to oscillate in a horizontal plane for undercutting a horizontal slot in the material in advance of the direction of motion of said leading edge.

4. The machine of claim 3 including:

at least one module containing an arcuately movable oscillating nozzle mounted on the top of said body portion adjacent said leading edge and oriented to oscillate in a horizontal plane for top-cutting a horizontal slot in the material in advance of the direction of motion of said leading edge.

5. The machine of claim 3 including:

at least two modules mounted on said body portion with one on top of the other and oriented to cut a continuous vertical slot in the material.

6. The machine of claim 5 wherein:

said modules are offset longitudinally with respect to said leading edge of said body portion in the direction of travel whereby the size of pieces of material excavated can be regulated.

* * * * *